US006260591B1

(12) United States Patent
George et al.

(10) Patent No.: US 6,260,591 B1
(45) Date of Patent: Jul. 17, 2001

(54) BISCUIT JOINER

(75) Inventors: William A. George, Parkton; Steven D. Beamesderfer, Cockeysville; Dennis Keith Kirk, Jr., Finksburg, all of MD (US); Sean W. Flickenger, Felton, PA (US); Richard H. Rapuano, Towson, MD (US); Gregg A. Flender, Bedford; George H. F. Schnakenberg, III, Cambridge, both of MA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/372,311

(22) Filed: Aug. 11, 1999

(51) Int. Cl.[7] ..... B27C 5/10

(52) U.S. Cl. ..... 144/136.95; 16/110.1; 81/177.3; 144/154.5

(58) Field of Search ..... 30/122; 16/110.1; 81/177.1, 177.3; 144/136.95, 154.5; 409/182

(56) References Cited

U.S. PATENT DOCUMENTS

| | | |
|---|---|---|
| D. 295,945 | 5/1988 | Sakamoto et al. . |
| D. 315,281 | 3/1991 | Bosten et al. . |
| D. 327,400 | 6/1992 | Fushiya et al. . |

(List continued on next page.)

FOREIGN PATENT DOCUMENTS

| | | |
|---|---|---|
| 23 00 964 | 1/1974 | (DE) . |
| 3734013C1 | 3/1989 | (DE) . |
| 36 31 535 C2 | 10/1991 | (DE) . |
| 40 40 578 A1 | 7/1992 | (DE) . |
| 42 03 171 C1 | 6/1993 | (DE) . |
| 41 30 174 C2 | 11/1993 | (DE) . |
| 44 32 974 A1 | 3/1995 | (DE) . |
| 195 02 977 A1 | 8/1996 | (DE) . |
| 196 08 969 A1 | 9/1997 | (DE) . |
| 196 06 535 C2 | 1/1999 | (DE) . |
| 0 374 600 B1 | 12/1989 | (EP) . |
| 0 558 503 B1 | 10/1991 | (EP) . |
| 0 618 051 B1 | 2/1994 | (EP) . |
| 0 726 121 A2 | 8/1996 | (EP) . |
| 0 726 121 A3 | 8/1996 | (EP) . |

OTHER PUBLICATIONS

Article in "Woodshop News" concerning Lamello cordless electric plate joiner, dated Oct. 1995.

*Primary Examiner*—W. Donald Bray
(74) *Attorney, Agent, or Firm*—Harness, Dickey & Pierce, P.L.C.

(57) ABSTRACT

A biscuit joiner (10) having a housing (16) which includes a forward portion (26), a handle portion (28) and a rear portion (30). A battery pack (56) is removably secured to the rear portion. The forward portion houses an electric motor (32) and is attached to a shoe assembly (12) and a fence assembly (14). The handle portion includes a stick handle portion (40) and a loop portion (42). Each of the stick handle and loop portions are laterally offset from the forward portion, and therefore from the rotational axis of the motor and the coaxial center of the housing. The stick handle portion is graspable by a user and the lateral offset enables the fingers of the user to be placed in position to exert a force substantially along the longitudinal axis (36) of the motor while engaging an ON/OFF trigger (46) of the joiner. In this manner a more direct application of force can be made by the user to the housing when urging the housing linearly while making plunge cuts with the joiner. The handle construction also provides the joiner with a well balanced, positive "feel" and enables a wider variety of hand orientations to be used when operating the joiner. The joiner of the present invention is even more comfortable to operate than previously developed stick handle type joiners, even with the additional weight of the removable battery pack, and can therefore reduce the fatigue of the user's hands and arms when the joiner is operated over prolonged periods of time.

26 Claims, 3 Drawing Sheets

U.S. PATENT DOCUMENTS

| | | | | |
|---|---|---|---|---|
| D. 330,836 | | 11/1992 | Fushiya et al. . | |
| D. 350,468 | | 9/1994 | Chunn et al. . | |
| 3,757,194 | | 9/1973 | Weber et al. . | |
| 3,973,179 | | 8/1976 | Weber et al. . | |
| 4,461,330 | | 7/1984 | Judkins . | |
| 4,622,749 | | 11/1986 | Inagaki . | |
| 4,858,661 | | 8/1989 | Bosten et al. . | |
| 4,858,662 | | 8/1989 | Bosten et al. . | |
| 4,858,663 | | 8/1989 | Bosten et al. . | |
| 4,913,204 | | 4/1990 | Moores et al. . | |
| 5,140,249 | | 8/1992 | Linder et al. . | |
| 5,291,928 | | 3/1994 | Keith, Jr. et al. . | |
| 5,758,702 | * | 6/1998 | Adams | 144/136.95 |
| 5,865,230 | | 2/1999 | Smith et al. . | |
| 5,881,784 | * | 3/1999 | Morikawa et al. | 144/136.95 |
| 5,921,928 | | 3/1994 | Keith, Jr. et al. . | |

* cited by examiner

BISCUIT JOINER

TECHNICAL FIELD

This invention relates to plate or biscuit joiners, and more particularly to a cordless biscuit joiner having an ergonomically formed handle portion to enable a user to more comfortably handle the tool more closely to the center of gravity of the tool, and to exert a linear force substantially along the longitudinal axis of the motor of the tool to thus further improve the operator's control over the tool and to further reduce operator fatigue when using the tool.

BACKGROUND OF THE INVENTION

Biscuit joiners are used in a variety of wood-working applications to cut slot-like recesses into the surfaces of wood members that are to be joined in facing relationship to one another. Typically, glue is applied to one or both of the recesses and a wood disc-like member termed a "biscuit" is urged into one of the recesses such that it projects partially therefrom. The other wood member is placed adjacent the protruding edge of the biscuit and the protruding edge is then urged into the recess of the facing wood member as the two wood members are forced against each other.

Traditional biscuit joiners typically incorporate some form of shoe assembly which houses the cutting blade. A fence assembly allows the wood member to be positioned thereagainst at a desired angle relative to the shoe assembly. A stick-type handle/housing is secured to the shoe assembly and encloses the electric motor of the tool. The rear portion of the handle/housing forms a generally cylindrical stick-type handle which the user grasps when using the joiner. The user exerts a force toward the wood member being cut which causes the cutting blade to be urged outwardly of the shoe assembly to thereby cut the slot-like opening in the wood member. One such type of joiner is presently offered by the assignee of the present application in an AC powered version, which has been very well received in the industry.

When adding a battery pack to a stick-handle type joiner, it is even more important to consider the ergonomics of the tool and how the additional weight of the battery pack influences the overall feel and comfort of use of the tool. Preferably the battery pack should not upset the overall balance of the tool or require additional effort to be expended by the user when using the tool just to compensate for the additional weight of the battery.

With traditional joiners having a stick-type handle, the precise orientation of the stick handle portion of the tool has been found to significantly influence the ease and comfort with which the joiner can be operated. In this regard, it has been found that orientating the stick handle relative to the longitudinal axis of the motor is an important factor in helping to achieve an even more balanced, positive "feel" during use of the joiner. Specifically, it has been found that if the stick handle portion of the joiner housing is offset laterally a small degree from the longitudinal axis of the motor, that a significant enhancement in the comfort and "feel" of the tool can be achieved. This is because the forward force applied by the user with the hand that is grasping the stick handle portion is applied even more directly along the longitudinal axis of rotation of the motor, and thus the main body portion of the tool.

Offsetting the stick handle portion slightly from the rest of the housing also enables the user to grasp the stick handle portion more forwardly thereon (i.e., to "choke up" on the stick handle portion) with his/her hand, thus enabling the user's hand to be placed closer to the overall center of gravity of the tool. These erogonomic improvements can help to significantly improve the comfort, balance and overall "feel" of the joiner, as well as to reduce the fatigue experienced by an individual when using the joiner over a prolonged period of time.

Accordingly, it is a principal object of the present invention to provide a biscuit joiner having a handle assembly which serves to place the hand of the user that is used to engage the ON/OFF trigger of the tool in an orientation which is even more comfortable and ergonomically efficient for the user. More specifically, it is an object to form the stick handle portion of the tool such that the user is able to exert a force, when using the tool, that is directed substantially along the longitudinal axis of the main body of the joiner. In this manner the force transmitted by the user's hand which is gripping the stick handle portion can be transmitted even more efficiently and comfortably when making plunge cuts with the joiner.

It is a further object of the present invention to provide a stick handle type biscuit joiner having a handle that is laterally offset slightly from the main body portion of the joiner to increase the ease with which a user can grip forwardly on the stick handle. This would enable the user to grasp the joiner closer to its center of gravity, and thus further contribute to a positive, well balanced "feel" when using the tool.

It is a further object of the present invention to provide a biscuit joiner having a handle assembly which helps to support the joiner on a planar work surface when the tool is not in use.

It is yet another object of the present invention to provide a stick handle type biscuit joiner which is powered by a removable, re-chargeable battery pack.

SUMMARY OF THE INVENTION

The present invention is directed to a biscuit joiner having an ergonomically designed handle assembly. The handle assembly comprises a stick handle portion and a loop portion. The stick handle portion is laterally offset from a motor housing portion of the joiner which encases an electric motor. The lateral offset of the stick handle portion even further improves the transmission of force by the hand that is grasping the stick handle portion during use of the joiner. The lateral offset of the stick handle portion also enables the user to grip more forwardly on the stick handle portion such that the hand that is grasping the stick handle portion is able to placed closer to the overall center of gravity of the joiner.

In one preferred embodiment the joiner comprises a cordless joiner having a removable, rechargeable battery pack. The joiner also includes a loop handle portion formed underneath the stick handle portion. The loop handle portion and the battery pack can both help to support the tool on a flat work surface when the tool is not in use. The loop handle portion can also enable the user to grasp and support the joiner with a wider variety of hand positions during use of the tool.

The various preferred embodiments provide a biscuit joiner which is more ergonomically efficient and even more comfortable to operate than previously designed joiners, even when a rechargeable battery pack is attached to the rear area of the joiner. The stick handle and loop handle portions further enable a wider variety of hand positions to be accommodated comfortably when using the joiner while providing the tool with a well balanced "feel". These features help to reduce operator fatigue when using the joiner over a prolonged period of time.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
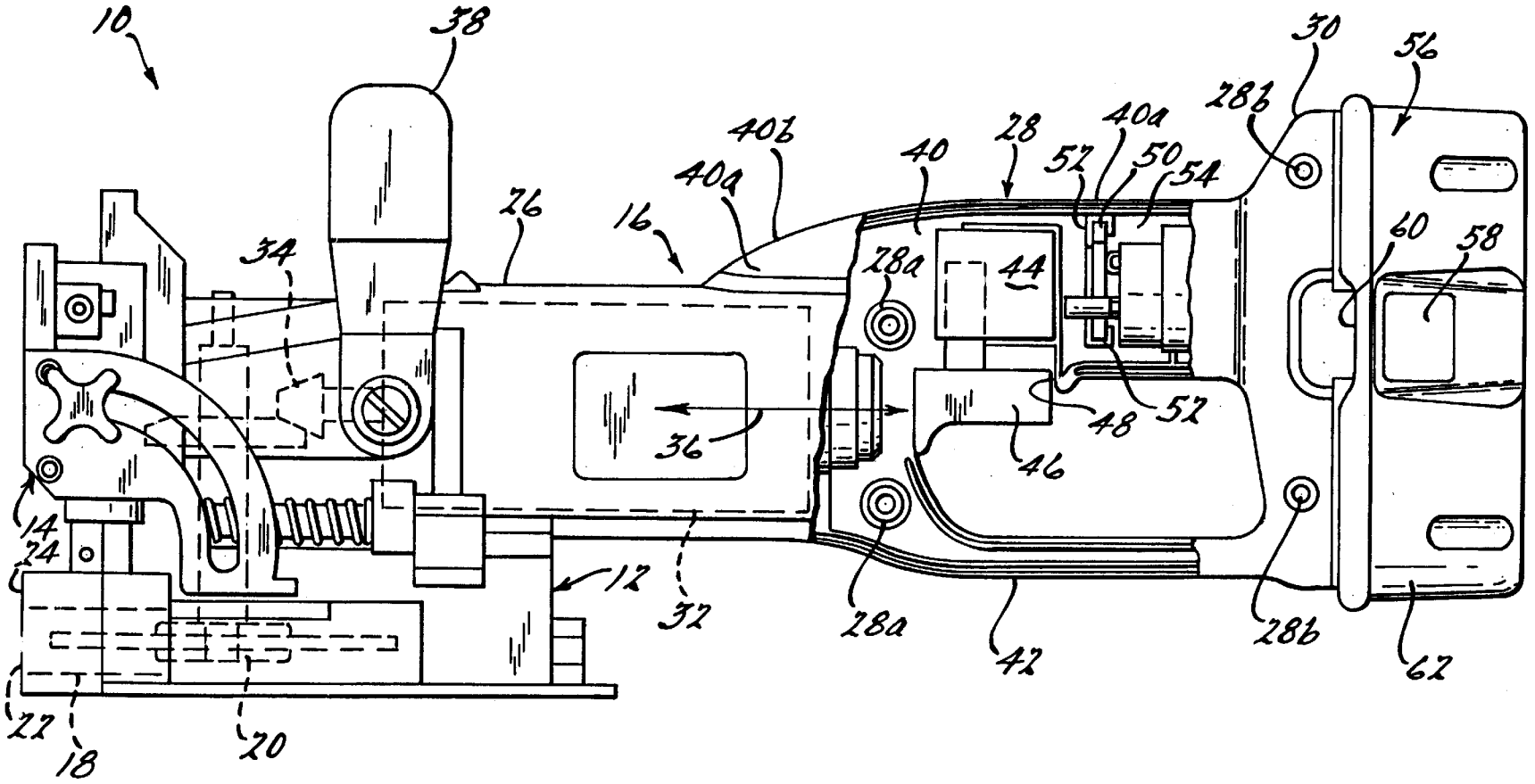
FIG. 1 is a fragmentary side view of a preferred embodiment of a biscuit joiner of the present invention with a portion of a two-piece clamshell handle portion thereof broken away to illustrate the various components disposed therewithin.
Figure 2:
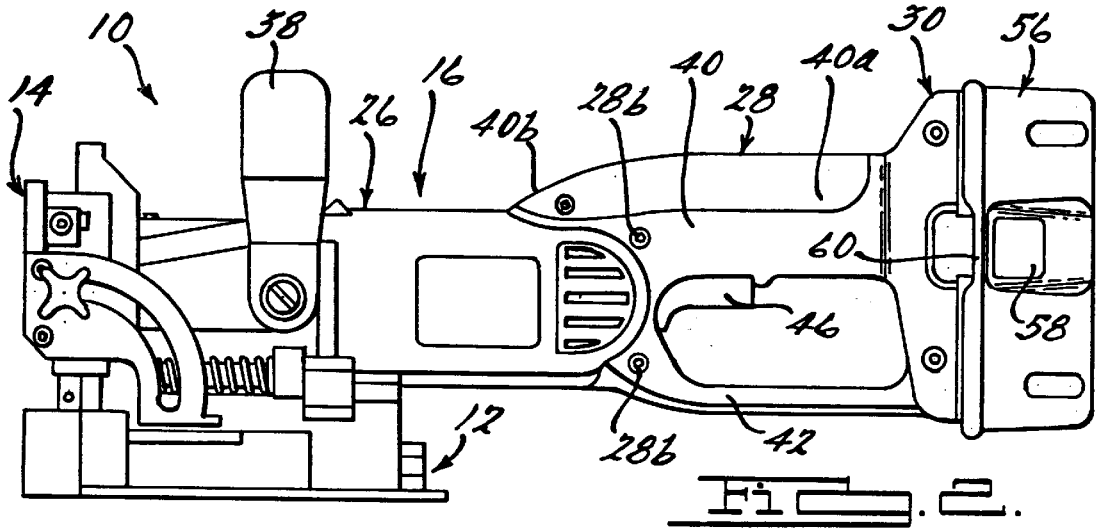
FIG. 2 is a side elevational view of the biscuit joiner of FIG. 1.
Figure 3:
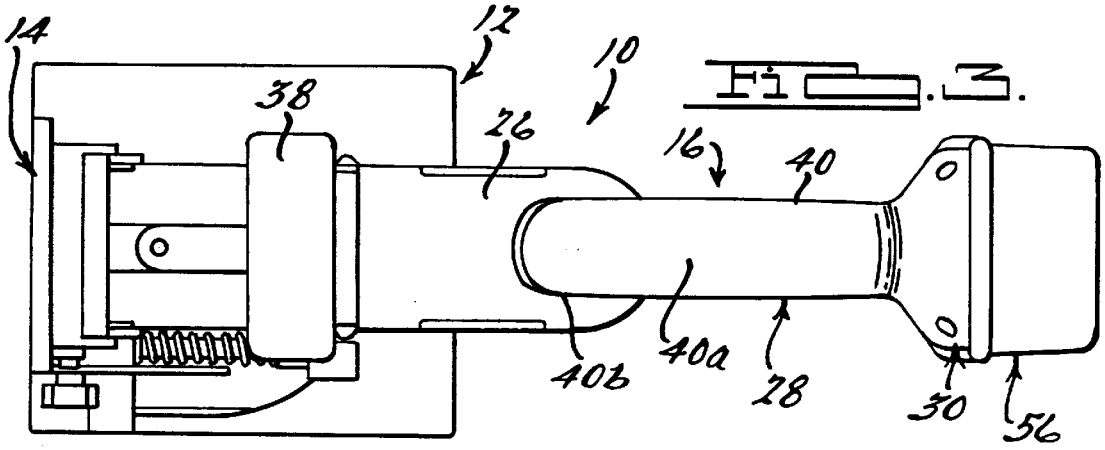
FIG. 3 is a top plan view of the joiner of FIG. 2.

Referring to FIGS. 1–3, a biscuit joiner 10 is shown in accordance with a preferred embodiment of the present invention. Referring specifically to FIG. 1, the biscuit joiner generally comprises a shoe assembly 12 and a fence assembly 14 which are each attached to a housing 16. The shoe assembly 12 has a recess 18 within which is disposed a cutting blade 20. An opening 22 at a front portion 24 of the shoe assembly 12 enables the cutting blade 20 to be urged outwardly of the shoe assembly 12 during use of the joiner 10.

The housing 16 includes a forward portion 26, a handle portion 28 and a rear portion 30. The forward portion 26 houses an electric motor 32 having an output shaft coupled to a gear reduction assembly 34. The gear reduction assembly 34 has its output coupled to the cutting blade 20. The longitudinal axis of rotation of the output shaft of the electric motor 32, which coincides with the approximate coaxial center of the forward portion 26, is indicated by arrow 36. A forward handle 38 is secured to the forward portion 26 of the housing 16. Further details of the construction of fence assembly 14 and the shoe assembly 12 can be found in U.S. Pat. No. 4,913,204, assigned to the assignee of the present application, and the disclosure of which is hereby incorporated by reference.

The forward portion 26 of the housing 16 is formed as a generally circular, single-piece section. The handle portion 28 extends from the forward portion 26 and is formed in a two-piece, clamshell-type configuration. The two housing halves comprising the handle portion 28 are held together by threaded screws 28b that engage in four bosses 28*a* (only two of which are visible in FIG. 1). The housing 16 is preferably manufactured from suitable high strength plastics through conventional injection molding techniques.

The handle portion 28 includes a main or stick handle portion 40 which is slightly oblong when assembled and viewed in cross-section. A foam-like material 40*a* which serves as padding for the user's hand can also be secured to an upper portion of the stick handle portion 40 by a suitable adhesive, as best seen in FIGS. 2 and 3. The stick handle portion 40 also includes an arcuate portion 40*b* providing a comfortable position for the user's thumb. As will be explained more fully in connection with FIG. 5, the arcuate portion 40*b* enables a user to grip the stick handle portion 40 more forwardly thereon so that the user's hand is closer to the overall center of gravity of the joiner 10.

A loop portion 42 also extends from the forward portion 26 of the housing 16 to the rear portion 30. Each of the stick handle portion 40 and loop portion 42 are formed so as to be offset laterally from the central longitudinal axis of the forward portion 26, which coincides with the longitudinal axis of the forward portion 26 of the housing 16 and also with the longitudinal axis of rotation of the motor 32, indicated by arrow 36. This lateral offset enables a force to be transmitted by the user's hand even more directly along the longitudinal axis of the motor 32 and the forward portion 26 of the housing 16, and therefore enhances the ergonomic efficiency and comfort to the user when using the joiner 10.

The stick handle portion 40 of the handle portion 28 further includes an electrical ON/OFF switch 44 having a trigger portion 46 used for electrically closing the switch. The trigger portion 46 is disposed for sliding movement through an opening 48 in the stick handle portion 40. The switch 44 is a normally open, spring biased switch which is electrically closed when the user actuates (i.e., squeezes) the trigger portion 46.

The switch 44 is electrically coupled between the electric motor 32 and a terminal block 50 via suitable electrical conductors (not shown). The terminal block 50 is supported within a pair of channels 52 protruding from an interior surface 54 of the stick handle portion 40. The terminal block 50 is used to electrically couple DC power from the electrical contacts of a removable battery pack 56 to the motor 32 when the battery pack 56 is attached to the housing 16. The battery pack 56 is held removably to the housing 16 by a pair of identical, resilient latch arms 58 on opposite sides of the rear portion 30 of the housing 16 (with only one latch arm 58 being visible in FIGS. 1, 2 and 4). The latch arms 58 extend through openings 60 formed in a casing 62 of the battery pack 56 and engage with the casing 62 to hold it securely to the rear portion 30 of the housing 16.

The battery pack 56 is of the rechargeable type and therefore comprises one or more lead acid battery cells or nickel cadmium cells. It will be appreciated, however, that the joiner 10 could just as easily be modified to be powered from an AC power source. Also, it is anticipated that an AC/DC converter could also be used to provide power to the joiner 10 in place of the battery pack 56. An AC/DC converter would be helpful in the event the battery pack 56 becomes discharged to the point where a task cannot be completed without first recharging the battery pack 56. In this event, the AC/DC converter could be attached to the joiner 10 in place of the battery pack 56 and then a power cord of the converter plugged into an available AC power outlet. This would provide power to enable the joiner 10 to be used to complete the woodworking task at hand. It is further anticipated that such an AC/DC converter could be used with the joiner 10 with little or no modification to the joiner 10. The only exception would be the need for the joiner 10 to be "double insulated", as known in the art, to meet existing safety standards for AC powered tools.

The rear portion 30 of the housing 16 is also enlarged so as to be able to better mate with the battery pack 56. By "enlarged" it is meant that the perimeter of the rear portion 30 extends laterally beyond the outer surface of the front portion 26 of the housing 16. This feature also enables the rear portion 30 along with battery 56 to help support the joiner 10 when the joiner is rested on a planar work surface when not in use.

Figure 4:
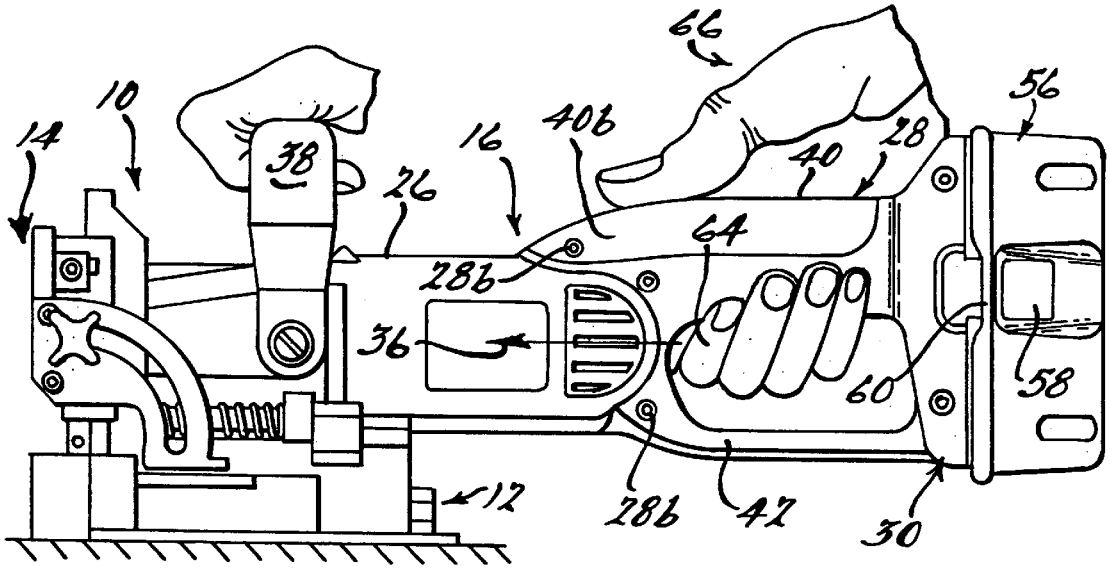
FIG. 4 is a side elevational view of the biscuit joiner of FIG. 2 illustrating how the lateral offset of the handle portion enables the fingers of a user to apply a linear force substantially along the longitudinal axis of rotation of the electric motor within the housing.

Referring now to FIG. 4, the operation of the joiner 10 will be described. It is a principal advantage of the joiner 10 that the stick handle 40 of the forward portion 26 is laterally offset from the longitudinal axis 36 about which the armature of the motor 32 rotates. This allows one grip to be used where the forefinger 64 of a user's and 66, as well as the remaining fingers being used to grasp the stick handle portion 40, are able to exert a force even more directly along the longitudinal axis 36 of the forward portion 26 of the housing 16. This direct application of force along the longitudinal axis 36 provides the user with an even more positive and balanced "feel" when using the joiner 10. It also substantially eliminates the small moment arm that could be created if the user is exerting a force which is directed along a line laterally offset from the motor rotational axis while making a plunge cut with the joiner 10.

The laterally offset configuration of the stick handle portion 40 significantly adds to the comfort and ease in using the joiner 10. This feature also serves to help reduce hand and arm fatigue when the joiner 10 is used repeatedly over a short period of time.

Figure 5:
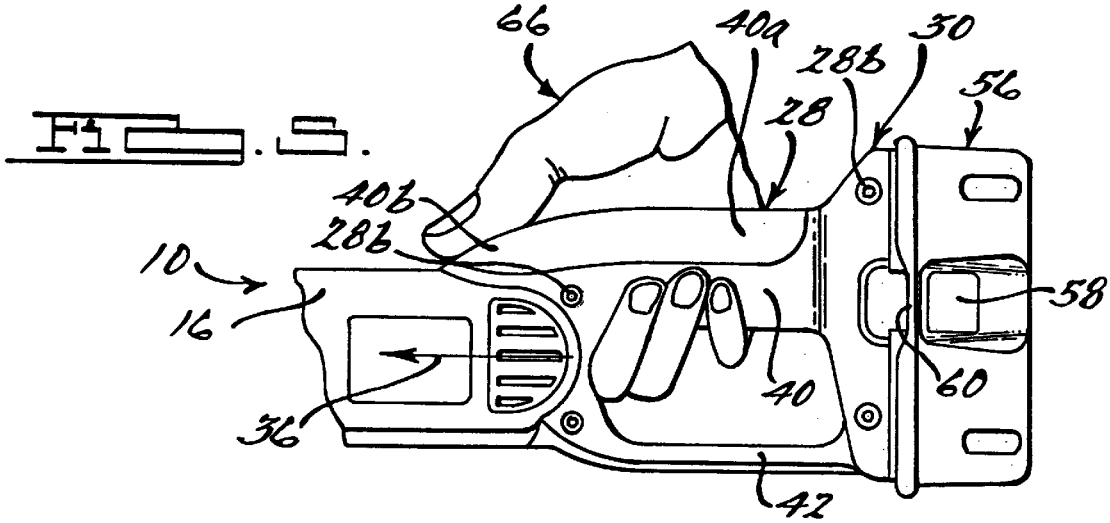
FIG. 5 is a side elevational view of the biscuit joiner of FIG. 2 illustrating a hand of a user gripping at a more forward position on the stick handle portion.

Referring to FIG. 5, another grip orientation is illustrated. Here the joiner 10 is illustrated with the user grasping the stick handle portion 40 at a more forward portion thereof. In this position, the hand 66 of the user that is grasping the stick handle portion 40 is very close to the center of gravity of the joiner 10. This provides the user with an excellent sense of control and a balanced "feel" for the joiner 10 when handling and making plunge cuts with the joiner 10.

Figure 6:
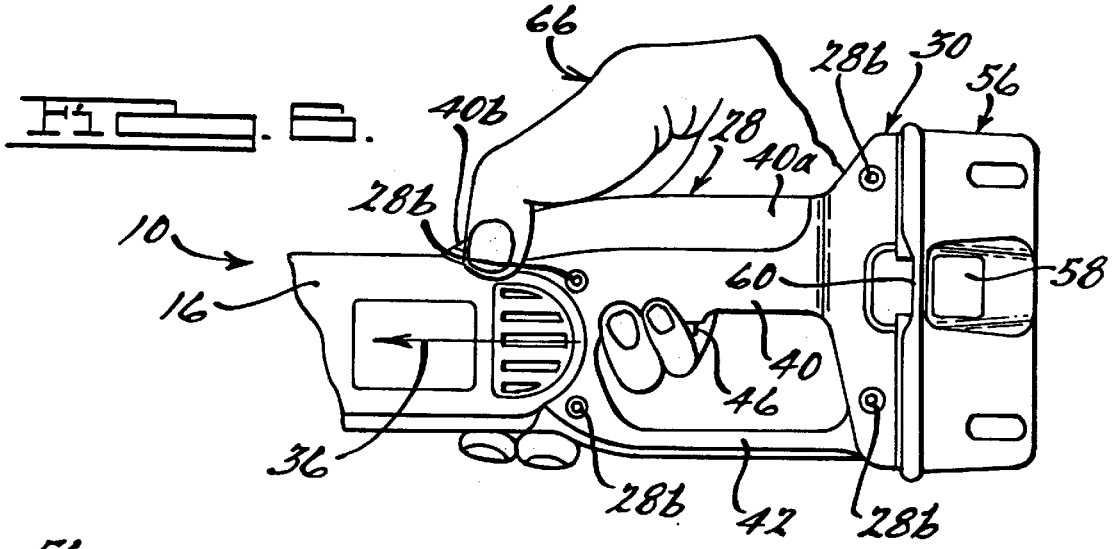
FIG. 6 is a side elevational view of the biscuit joiner of FIG. 2 illustrating a hand of a user gripping at an extreme forward position on the stick handle portion.

FIG. 6 illustrates the stick handle portion 40 being grasped at a forwardmost portion thereof. With this grip the last two fingers of the user's hand 66 can be used to engage and hold the trigger portion 46.

Figure 7:
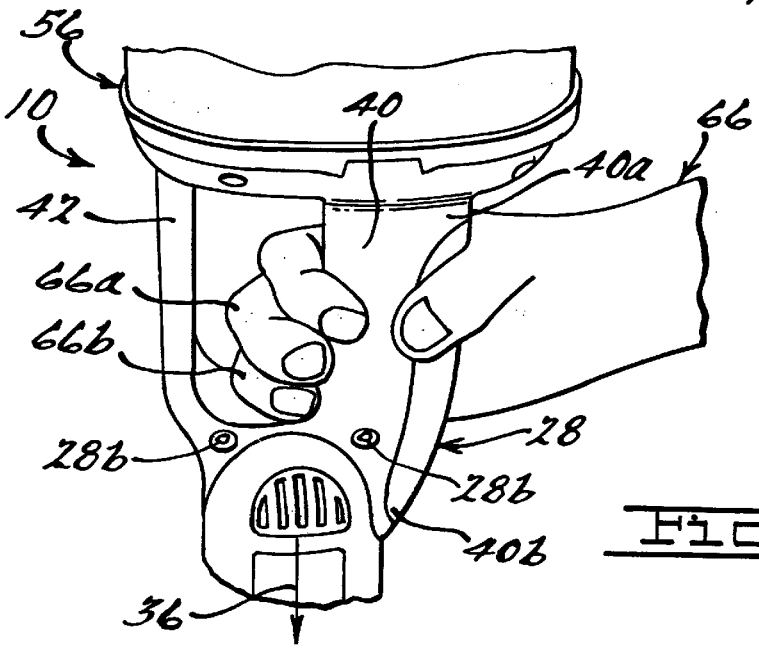
FIG. 7 is a side elevational view of the biscuit joiner of FIG. 2 illustrating the stick handle portion being grasped with a reverse grip to facilitate holding the joiner in a vertical orientation.

FIG. 7 illustrates the joiner 10 being held by the user's hand 66 with a reverse grip on the stick handle portion 40. With this grip, the trigger portion 46 can be engaged by the second and third fingers 66*a* and 66*b*, respectively, while the joiner 10 is held in a vertical orientation.

The handle portion 28 thus enables a variety of hand positions to be used, which makes the joiner 10 even more comfortable to operate than existing stick handle type joiners when the joiner 10 is used to make plunge cuts in workpieces that are positioned in a variety of angular positions. The joiner 10 can thus be held easily and comfortably in a variety of positions while providing a well balanced and positive feel. Importantly, the offset orientation of the stick handle portion 40 permits the user to apply force directly along the housing 16 of the joiner 10, thus providing a positive, balanced feel to the joiner 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A joiner comprising:

a housing having a forward portion and an elongated handle portion, said elongated handle portion including a trigger switch;

an electric motor disposed within said forward portion of said housing, a longitudinal axis of said motor being aligned longitudinally with said trigger switch;

a cutting blade operably associated with said motor so as to by driven by said motor;

a shoe assembly for housing said cutting blade; and said elongated handle portion being graspable by a user and offset laterally from a longitudinal axis of said forward portion of said housing, to thereby place the fingers of a hand of the user approximately behind and generally longitudinally in-line with the forward portion of the housing and along said longitudinal axis of said motor when operating said joiner, thereby more effectively transmit a force exerted by said hand grasping said elongated handle to said cutting blade.

2. The joiner of claim 1, wherein said elongated handle portion comprises a stick handle portion, and wherein said lateral offset of said stick handle portion is sufficient to place said fingers along a longitudinal axis extending through a coaxial center of said forward portion of said housing and through an axis of rotation of said motor.

3. The joiner of claim 1, wherein said elongated handle portion comprises a stick handle portion and a loop portion both extending from said forward portion of said housing.

4. The joiner of claim 3, wherein said stick handle portion includes a trigger switch operably associated with said electric motor and disposed so as to be engageable with a finger of the user's hand when operating said joiner.

5. The joiner of claim 1, further comprising a removable battery pack coupled to said housing for powering said electric motor.

6. The joiner of claim 1, wherein said forward portion of said housing forms a tubular single piece portion of said housing for housing said electric motor.

7. The joiner of claim 1, wherein said elongated handle portion comprises a two-piece clamshell construction.

8. The joiner of claim 3, wherein said loop portion extends generally parallel with said main portion of said handle.

9. The joiner of claim 1, wherein said housing includes:

a rear portion separated from said forward portion by said elongated handle portion, said rear portion extending laterally beyond said forward portion to assist in supporting said housing on a work surface when said joiner is not in use.

10. A joiner comprising:

a housing having a forward portion and a handle portion, said handle portion having a trigger switch;

an electric motor disposed within said forward portion of said housing, wherein a longitudinal axis of said motor is aligned along a common longitudinal axis with said trigger switch;

a battery pack for powering said electric motor;

a cutting blade driven by said electric motor;

a shoe assembly secured to said forward portion of said housing for housing said cutting blade; and said handle portion of said housing having a stick handle portion which is graspable by a user and offset laterally from said forward portion, to thereby place the fingers of the user approximately along said longitudinal axis of said motor when said user is grasping said handle portion while operating said joiner, to thereby enable said user to apply a force with said hand that is substantially along said longitudinal axis of said forward portion of said housing.

11. The joiner of claim 10, wherein said housing further comprises a loop portion offset laterally from said forward portion of said housing and extending generally parallel to said stick handle portion.

12. The joiner of claim 11, wherein said housing includes a rear portion bridging said loop and stick handle portions, said rear portion further supporting said battery pack thereon.

13. The joiner of claim 12, wherein said battery pack is releasably secureable to said rear portion of said housing.

14. The joiner of claim 10, wherein said stick handle portion of said housing includes a trigger switch engageable by a finger of said user when grasping said stick handle portion.

15. The joiner of claim 10, further including a fence assembly and a forward handle secured to said fence assembly, said forward handle being graspable by one hand of the user when operating said joiner.

16. A joiner comprising:

a housing having an elongated forward portion, a stick handle portion and a loop handle portion each extending from said forward portion, at least said stick handle portion being laterally offset from said forward portion, and said stick handle and said loop handle portions being bridged by a rear portion of said housing to form a loop through which the fingers of a user may extend;

an electric motor disposed within said forward portion of said housing, wherein a longitudinal axis of said motor is aligned with a longitudinal axis of a trigger switch used to control operation of said motor; and a cutting implement driven by said electric motor.

17. The joiner of claim 16, further comprising:

a battery pack releasably secureable to said rear portion of said housing for powering said electric motor.

18. The joiner of claim 16, wherein said stick handle portion includes an ON/OFF trigger for actuating said electric motor.

19. The joiner of claim 16, wherein said stick handle portion is offset laterally a degree sufficient to place the fingers of a user substantially along a longitudinal axis of said forward portion of said housing when said user grips said stick handle portion with one hand.

20. The joiner of claim 16, wherein each of said stick handle portion and said loop handle portion are laterally offset from said forward portion of said housing.

21. A cordless plate joiner comprising:

a main housing having opposed ends;

an electric motor within the main housing;

a cutting blade connected to and driveable by the motor;

a shoe assembly connected to one end of the main housing;

a handle formed at the second end of the main housing;

the handle having a stick handle portion and a loop portion;

a battery pack bridging the loop and main portion of the handle; and wherein said motor is aligned longitudinally with said handle of said housing such that a trigger switch disposed on said handle is aligned with a longitudinal axis of said motor.

22. The cordless joiner of claim 21, wherein the housing further comprises a rear portion bridging said stick handle and said loop portions, said battery pack being removably secured to said rear portion.

23. The cordless joiner of claim 21, wherein said stick handle portion is laterally offset from, and extends generally parallel to, said main housing such that when said stick handle portion is gripped by a hand of a user, the fingers of said hand are positioned generally in line with a longitudinal axis extending through a general coaxial center of said main housing.

24. The cordless joiner of claim 21, wherein said stick handle portion includes a forward, rounded portion.

25. The joiner of claim 21, wherein said stick handle portion includes a trigger switch engageable by a finger of said user when said user is grasping said stick handle portion.

26. The joiner of claim 21, further comprising a forward handle secured at or adjacent said first end of said main housing and being graspable with said user's other hand when operating said joiner.

* * * * *

UNITED STATES PATENT AND TRADEMARK OFFICE

CERTIFICATE OF CORRECTION

PATENT NO. : 6,260,591 B1 
DATED : July 17, 2001
INVENTOR(S) : William A. George et al.

It is certified that error appears in the above-identified patent and that said Letters Patent is hereby corrected as shown below:

Title page,
Item [75], Inventors, "Sean W. Flickinger" should be -- Sean W. Flickenger --.

Signed and Sealed this

Twenty-fifth Day of February, 2003

JAMES E. ROGAN
*Director of the United States Patent and Trademark Office*